United States Patent [19]

Van Melle

[11] 4,421,244

[45] Dec. 20, 1983

[54] PLASTIC LID FOR CONTAINERS

[75] Inventor: Hubert Van Melle, Etobicoke, Canada

[73] Assignee: Amhil Enterprises Ltd., Mississauga, Canada

[21] Appl. No.: 300,371

[22] Filed: Sep. 8, 1981

[51] Int. Cl.[3] ..... B65D 41/18; B65D 43/03; B65D 43/10

[52] U.S. Cl. ..... 220/306; 206/508; 206/519; 220/380; 229/43

[58] Field of Search ..... 220/306, 380; 206/508, 206/519; 229/43, 7 R

[56] References Cited

U.S. PATENT DOCUMENTS

| | | | |
|---|---|---|---|
| 2,913,139 | 11/1959 | Freeman | 220/306 |
| 2,922,563 | 1/1960 | Aldinston | 220/306 X |
| 3,065,875 | 11/1962 | Negoro | 220/306 |
| 3,353,708 | 11/1967 | Davis | 220/306 X |
| 3,387,765 | 6/1968 | Davis | 220/306 X |
| 3,583,596 | 6/1971 | Brewer | 220/306 |
| 3,883,036 | 5/1975 | Mahaffy | 220/306 |
| 4,194,645 | 3/1980 | Zabner et al. | 220/306 |
| 4,275,815 | 6/1981 | Davis | 220/306 X |

*Primary Examiner*—Allan N. Shoap

*Attorney, Agent, or Firm*—Donald E. Hewson

[57] ABSTRACT

A lid for containers, usually beverage cups which may be for hot beverages or cold beverages, is provided, having a cavity adapted for seating against the bead of the container. A skirt extends downwardly from the cavity, having a number of outwardly extending projections formed in it, each of the projections having a substantially rectangular appearance with a vertical face and vertical side walls. The portions of the skirt between the outwardly extending projections extend inwardly to form a discontinued waist having an undercut which defines the cavity in the waist portion; the cavity being defined by a higher and less inwardly extending undercut over the top portion of each of the outwardly extending projections. Beneath the projections and the waist portions between them there extends outwardly and downwardly a lower band portion; below which may be a vertically extending wall, and which may have an outwardly turned lip at its bottom. The lid is generally formed of thin, flexible plastic, such as polystyrene, usually by a thermoforming process on male moulds, from which the lid may be easily stripped. The lid has a lower stacking height and is less likely to be stripped from a cup by rubbing against another lid on another cup.

8 Claims, 5 Drawing Figures

PLASTIC LID FOR CONTAINERS

FIELD OF THE INVENTION

This invention relates to a lid for containers, and in particular lids for beverage containers. The lid of the present invention may be applicable for use with containers designed for holding hot beverages or cold beverages, but is more particularly intended for use with cold beverages. The lid of the present invention is intended to be formed using vacuum thermoforming process, from thin, flexible plastic sheet material, usually polystyrene.

BACKGROUND OF THE INVENTION

Disposable lids for containers such as beverage cups, food cups, and the like, are well known. Usually, when such lids are disposable, they are made from an inexpensive thin, flexible plastic material, such as polystyrene; which, however does not have a significant amount of elasticity. Therefore, in order to be able to be placed over and removed from the bead of a container, the lids must be designed in such a manner that they have a so-called "garter-spring" configuration. This configuration comprises a plurality of convolutions or corrugations, or other protruberances, formed on the skirt portion of the lid.

By so configuring cup lids and lids for food cups and the like, such lids may be applied to and removed from the container at least once, after which they are usually disposed of. However, the lids must also first be stripped from the mould on or in which they are made.

Certain difficulties have arisen from previous designs, including difficulties in stripping the lids from moulds, causing deformations or stress failure in the material of the lids, or requiring special stripping stations which add to the expense of lid production and which may slow down the process of production.

Moreover, even though a lid may be designed to fit a cup having a particular dimension, the manufacturing tolerances by which such cups or other containers may be produced are such that the diameter of the rim or mouth of the container, or the size of the bead formed at the outer edge of the container, may vary significantly, so that lids designed to fit such containers having a nominal size may not, in fact, do so. This may result in a container which is much inclined to leakage around the lid, and very often results in an inadvertent stripping or dislodging of the lid from the container mouth, particularly when more than one container, each having its own lid, may be placed in a bag or other receptacle for carrying.

Still further, the space taken for shipping and storage of priior art lids has sometimes been quite significant. For example, food vendors or the like may sometimes find that the designated space that they have for lid storage, in which they expect to store a specific number of lids as received from the manufacturer, may not be quite enough space; or as a corollary, either the producer of the lids or the food vendor may wish to store more lids in a given amount of space. The present invention provides a lower stacking height, so that each lid occupies a somewhat smaller volume, which may be significant when storage of lids in amounts of thousands or even millions or such lids is considered.

Certain prior patents are particularly indicative of the kinds of lids in respect of which the present invention provides an improvement; particularly as to ease of stripability from moulds, lessening of the likelihood of inadvertent removal from a container when placed thereon, and accommodation of a wider tolerance of container sizes of a nominal size.

Included among the prior art patents of interest is Aldington, U.S. Pat. No. 2,922,563, issued Jan. 26, 1960. That patent is specifically concerned with the provision of a container closure which has a downwardly and outwardly flared skirt which is then corrugated, and above and inwardly of the skirt there is located a cavity for fitting to the bead of a container. Aldington is also concerned with stackability, by which lateral shifting of stacked lids relative to each other is precluded. However, lids of the sort taught in Aldington are formed in female dies or moulds, and may be easily dislodged from a container on which they are placed if they are jostled against other such lids on containers.

Negoro, U.S. Pat. No. 3,065,875, issued Nov. 27, 1962, teaches a snap-on plastic cup lid having a garter-spring flexibility in the skirt portion to permit fitting to a cup bead, but which only accommodates and fits to the cup bead discontinuously around the circumference thereof by virtue of projections formed in the skirt portion.

Yet another approach is taken by Brewer, U.S. Pat. No. 3,583,596, issued June 8, 1971—reissued as U.S. Pat. No. Re. 28,797, on May 4, 1976, with the same disclosure. Brewer provides a lid having a conical skirt in which is formed a plurality of spaced flutes, which vary in dimension from top to bottom, and which provide telescopic rigidity to the skirt with sufficient conical strength to adapt to the bead of the cup. Brewer is particularly concerned with nesting and stacking, and provides three spaced stacking lugs in the central panel for that purpose.

A different approach, particularly to mounting the plastic container closure on the container, is taken by Blanchard, U.S. Pat. No. 4,026,459, issued May 31, 1977. Blanchard provides a series of protruberances around the outside wall of the container, which thereby provides a discontinuous bead to grip the rim of the cup or container. Each of the protruberances may be disengaged from the rim of the container, without causing displacement of adjacent protruberances from engagement with the rim.

None of the above, nor any other known flexible plastic lid for containers for food or beverages, whether hot or cold, provides a lid which has a generally central panel and a circumferentially extending cavity which opens downwardly and inwardly to receive the bead of the container to which the lid is to be fitted, where the skirt portion which extends downwardly from the cavity has a plurality of outwardly extending projections, each of which has a substantially vertical face and substantially vertical side edges and side walls which extend inwardly from each face of each projection, and where the portions of the skirt between the outwardly extending projections, extend inwardly to form a discontinued waist which has an undercut defining the cavity in the waist portions. Each of the outwardly extending projections, and each of the discontinued waist portions between them, all terminate at their lower portions in a downwardly and outwardly sloped lower band portion. The lower band portion may, in turn, terminate at a substantially vertically disposed downwardly extending wall portion, which may generally have an outwardly turned lip at its bottom. All of the outwardly extending projections terminate at a respective upper discontinued band portion which extends inwardly and upwardly from the upper edge of each of the vertical faces of the projections, each of which terminates at the cavity at an upper undercut which is higher and less inwardly extending than the undercut of the waist portions, but which also defines the cavity.

Thus, the present invention provides a thermoformed, thin plastic lid for containers, generally formed of a plastic which has no significant amount of inherent elasticity, and which has a continuous cavity formed at its upper periphery in such a manner that the cavity can accommodate the beads of different sized containers which have a given nominal size; i.e., the bead-receiving cavity of lids of the present invention may accommodate a wide tolerance of bead size and mouth diameter of containers for which any such lid is nominally intended to be used as a closure therefor.

Moreover, the present invention provides lids of the sort spoken of above, which have a lower stacking height than prior art lids, thereby permitting more lids to be stored in the same space.

Still further, the present invention provides lids which may be formed on male moulds, a process which is somewhat less expensive and more positive as to the interior dimensions of the lid—which are the dimensions intended to be fitted to the rim or mouth of a container—and yet the lids of the present invention are easily stripped from the moulds on which they are made.

Still further, the present invention provides lids which are less likely to be disengaged from the container on which they are fitted by jostling against similar lids on similar containers.

BRIEF DESCRIPTION OF THE DRAWINGS

The above features and objects of the present invention will become more evident, and are discussed in greater detail hereafter, together with other advantages of the present invention, in association with the accompanying drawings, in which.

DESCRIPTION OF THE PREFERRED EMBODIMENTS

Figure 1:
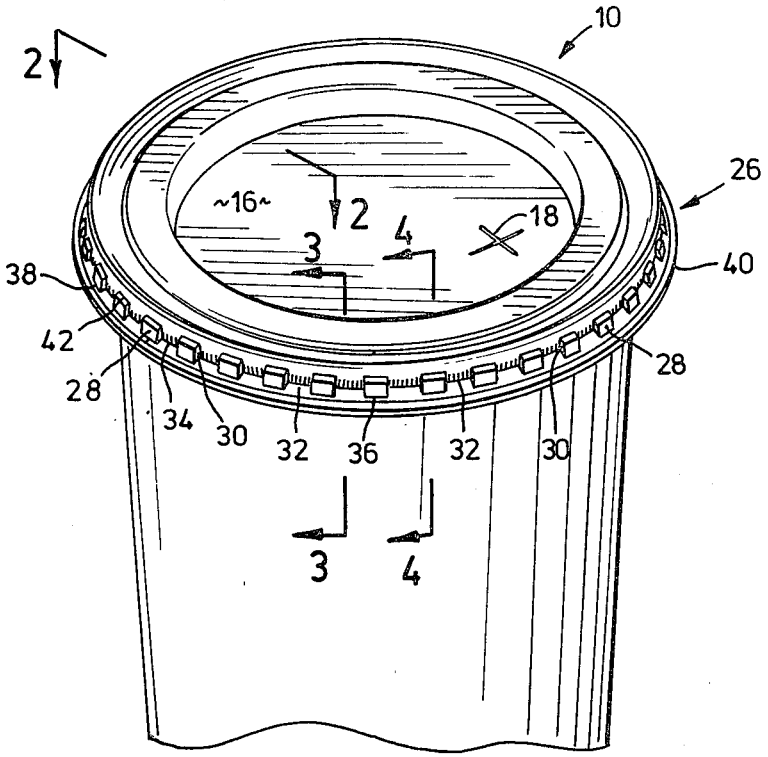
FIG. 1 is a perspective view of a lid according to the present invention fitted to a typical container.
Figure 2:
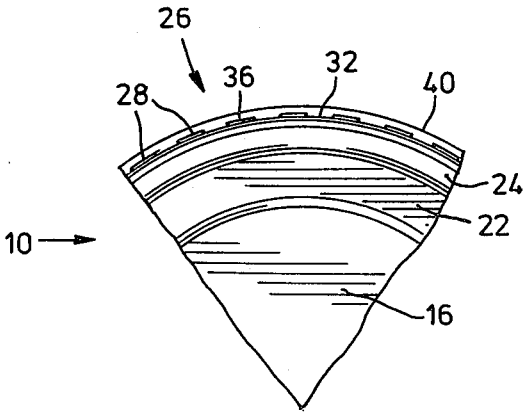
FIG. 2 is a partial plan view from above, looking in the direction of arrows 2—2 of FIG. 1.

As noted, the present invention provides a lid 10, which is intended for use with a container 12. The lid 10 is formed of thin, flexible plastic material, usually polystyrene. If the lid is made of polystyrene plastic material, that material is such that it does not generally have any significant amount of elasticity, but is flexible. Indeed, the lid 10 of the present invention is generally intended for manufacture using a vacuum thermoforming process on male moulds, by which the inside dimensions of the lid may be more particularly defined and controlled. This is discussed in greater detail hereinafter.

The container 12 may generally be a paper container or tub, intended for use with hot or cold beverages, milkshakes or foodstuffs such as salads or the like. Usually, such containers are formed of paper and may have a plastic or wax coating or lining, and have a bead formed on the outer edge of their upper periphery or mouth, such as the bead designated 14 in FIGS. 3 and 4.

The lid 10 has a generally central panel 16, in which there may be formed a vent or cross cut opening 18, through which a drinking straw may be inserted.

Specifically, the lid 10 has a peripherally extending cavity 20 which is formed at the upper and outer extremity of the lid, for receiving the bead 14 of the container 12 to which the lid is to be fitted. The cavity 20 opens downwardly and inwardly, in order to receive the bead 14.

Means such as an upwardly extending circular rim 22 and an inner skirt 24 may be provided, for connecting the cavity 20 to the central panel 16; but the precise configuration is immaterial to the present invention.

The outer portion of the lid 10 comprises a skirt, generally designated at 26, which extends downwardly from the cavity 20. Formed in the skirt 26 are a plurality of outwardly extending projections 28, each of which has a substantially rectangular front face, defined by vertical side edges and inwardly extending vertical side walls 30. Between the outwardly extending projections 28 there are portions 32 of the skirt 26, which extend around the lid 10 in the skirt portion 26 to form a discontinued waist indicated at 34. The waist 34 forms an undercut which thereby defines the cavity 20 in the waist portions 32.

The outwardly extending projections 28 and the discontinued waist portions 32 all terminate at their lower portion in a downwardly and outwardly sloped lower band portion 36. The lower band portion 36 may, in turn, terminate at a substantially vertical, downwardly extending wall portion 38; which, in turn, may terminate at an outwardly extending lip 40.

Each of the outwardly extending projections 28 terminates at a discontinued band portion 42, which extends inwardly and upwardly from the vertical outer face of each outwardly extending projection 28. Each band portion 42 terminates at the cavity 20 at an undercut 44, which is higher and less inwardly extending than the undercut 34, and which also defines the cavity 20 in each region of the skirt portion 26 over the outwardly extending projections 28.

Figure 3:
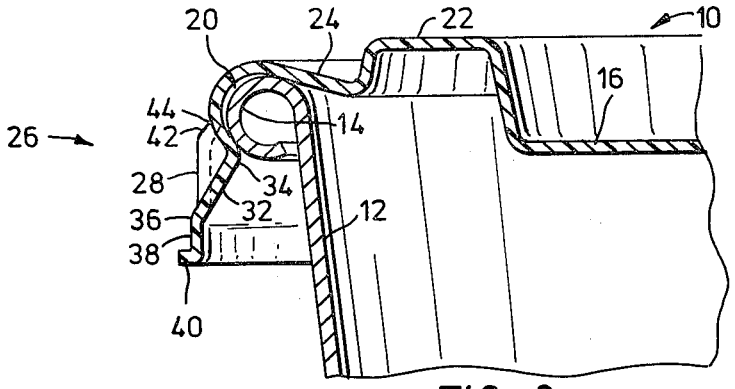
FIG. 3 is a partial cross-section of a lid, taken on line 3—3 of FIG. 1.

FIG. 3 is taken through a waist portion 32, so as to indicate the relationship of the cavity 20 and the undercut 34 to the bead 14 of a container 12. Likewise, FIG. 4 is taken through an outwardly extending projection 28, to demonstrate the relationship of the undercut 44 to the bead 14 and container 12.

Very evidently, as a lid 10 is being placed over the bead 14 of the container 12, it flexes in each undercut portion 34, sufficiently that the lid may be pushed downwardly over the bead, so that it then accommodates the bead due to its flexibility.

Figure 4:
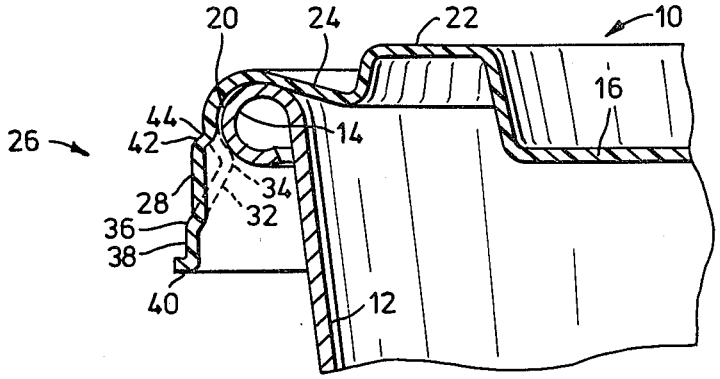
FIG. 4 is a partial cross-section similar to FIG. 3 but taken on line 4—4 in FIG. 1.

What is also evident, from the above discussion and with reference particularly to FIGS. 3 and 4, is that a wide tolerance of bead dimensions and of outer diameter dimensions, from extremities of the bead 14 of containers 12, may be accommodated, due to the interaction of both of the undercuts 44 and 34 against the bead 14. Thus, a tight fit of the lid 10 to the bead 14 of the container 12 is assured, over a relatively wide range of bead sizes and outer diameters.

Morever, because it is advantageous to form the lids of the present invention on male molds, it is evident that the discontinuities of the undercuts 34 and 44 make it easier to strip the lids from the moulds on which they are formed.

Figure 5:
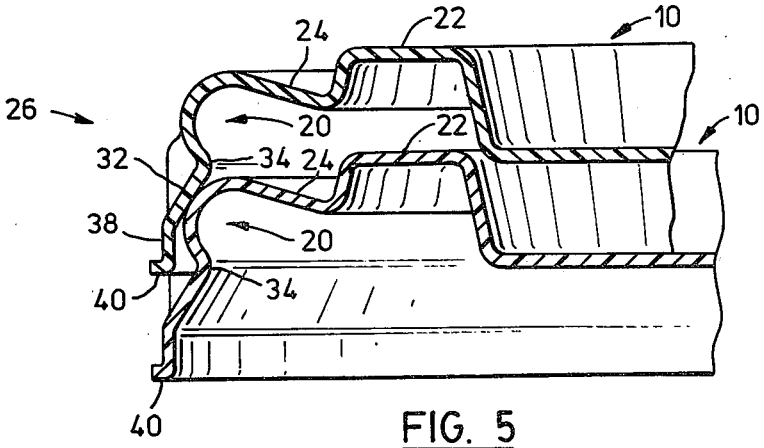
FIG. 5 is a partial cross-section showing a typical stacking arrangement of lids according to the present invention.

FIG. 5 shows one possible relationship of vertically contiguous lids 10 in a stacking arrangement, where that portion of the lid which defines the cavity 20 of the bottom lid extends up to and interferes with the underside of the waist portions 32 of the upper lid. Obviously, there may be a possibility that the upper and outer portion of the lower lid 10 may also extend up to and interfere with the upper band portion 42 of the upper lid 10. Thus, in that event, the lids would nest very closely one with another, if necessary.

The configuration of the lids is such that, in any event, when the lids are stacked and nest against each other, they do not lock one on another.

However, even in a normal stacking position as indicated in FIG. 5, it is clear that there is a minimal space taken for each lid, because of the relative nesting position in any event of the lids one with respect to the next adjacent lid above it.

Indeed, as an example, lids of a size intended to fit containers having a nominal diameter of 3.75 inches may stack such that one hundred lids occupies 15 inchs of height, as opposed to the 19 inches of height taken by ordinary lids of the sort, for example, that are illustrated in the Brewer patents referred to above. This represents a saving of 20% of storage volume; and when storage and shipping of lids in amounts of hundreds of thousands or millions is considered, such saving is quite significant.

On a lid of the present invention, it is usual that the circumferential length of each of the outwardly extending projections 28—i.e., the width across the face of the projections 28—is approximately the same as the circumferential length of the waist portions 32 between them. Such outwardly extending projections 28 may be put into place such that the distance between a point on one of them and the respective point on the next adjacent outwardly extending projection (e.g., between the centre lines of each), is 10 degrees.

In general, the cross-section of the cavity, in the portion thereof as illustrated in each of FIGS. 3 and 4, is transversely arcuate—i.e., at least the extreme outer portion of the material of the lid 10 which defines the cavity 20 forms a segment of an arc. Generally, the position of the upper undercut 44 is such as to be just below and inward of a vertical tangent to the material defining the cavity 20, at that point.

Obviously, because of the substantially straight sides in the skirt portions 26 of lids 10 according to the present invention, and the positive engagement of the undercuts 34 and 44 to the bead 14, there is considerably less likelihood of interference between adjacent lids as they may be jostled against one another when being carried in a bag or other receptacle, so that the likelihood of one of the lids being stripped from its respective container is lessened. Indeed, it is evident that, if the container is lifted by radially inwardly directed pressure between the thumb and fingers of the hand, against the skirt portitons 26 or against the outer edge of the rim portions 40 thereof, additional pressure of the undercuts 34 and 44 against the underside of the bead 14 of the container 12 is created, thereby even more particularly assuring a secure fit of the lid 10 to the container 12. That same pressure may also exist as adjacent lids 10 may rub or jostle against each other.

Also, because the bottom of the lower band portion 36 and the vertical wall 38 of the skirt portion 26 of the lid 10 according to this invention is at a wider diameter than that of the cavity 20, it is very easy to fit a lid 10 to a container. This wider bottom opening of a lid 10 according to this invention, is such that substantially automatic placement of lids 10 on containers may be accommodated, for example in dispensing machines.

Moreover, as mentioned above, the depth of the undercuts 34 provides an accommodation of a variety of bead sizes and bead diameters, for any specific nominal size of container 12. For example, lids having a diameter such as to accommodate cups having a nominal mouth diameter of 3.75 inches may have undercuts of 0.025 inches at each side as opposed to an undercut of 0.015 of the waist portion of lids such as those referred to in the Brewer patents mentioned above, thereby giving an additional 0.02 inches across the diameter of a cup or container. Thus, a variation of up to about 1% of nominal diameter of the mouth of the container 12, or indeed of the lid 10, may be accommodated. This is all the more important when it is recognized that shrinkage of polystyrene film material of the sort from which lids according to the present invention are normally manufactured may be up to 0.004 inches per inch of diameter of the lid, but variatitons of shrinkage are such that they may not be positively forecast and designed for in the manufacture of each die from which lids according to the present invention may be made. This is especially true when it is considered that the thickness of the polystyrene material, which is extruded, may vary from time to time and from machine to machine.

There has been described a lid for containers, which may be used with food tubs or cups for hot or cold beverages, for example, and which may normally be formed of thin, flexible plastic material such s polystyrene, using a vacuum thermoforming process over male moulds. Certain specific features of the lids according to the present invention have been described and their advantages explained. Other variations, and specific design considerations particularly as to the central panel portion, and as to the conformation of the wall portion 38 and rim 40 which may be eliminated, may be provided for, without departing from the spirit and scope of the appended claims.

What is claimed is:

1. A lid for containers, made of thin, flexible plastic, for mounting on and receiving the bead of a container, comprising:

a central panel;

a cavity extending around the periphery of the lid and opening downwardly and inwardly to receive the bead of a container to which said lid is fitted;

means connecting said cavity to said central panel;

a skirt portion extending downwardly from said cavity;

said skirt portion having a plurality of outwardly extending projections, each having a substantially vertical face with substantially vertical side edges, and substantially vertical side walls extending inwardly from said face;

the portions of said skirt that are between said outwardly extending projections extending inwardly to a waist portion hving a plurality of interruptions, one at each projection, and forming an undercut defining said cavity in said waist portion;

said outwardly extending projections and said waist portion all terminating in their lower extremities at a downwardly and outwardly sloped lower band portion;

and said outwardly extending projections terminating in their upper extremities at a respective upper, band portion extending inwardly and upwardly from the upper edge of each said respective vertical face and terminating at said cavity in an upper undercut which is higher and less inwardly extending than the undercut of said waist portion, and which defines the peripheral cavity over said outwardly extending projections.

2. The lid of claim 1, where said lower band portion terminates at a substantially, vertical downwardly extending wall portion.

3. The lid of claim 2, where said substantially vertical, downwardly extending wall portion terminates at an outwardly extending lip.

4. The lid of claim 1, 2 or 3, where said outwardly extending projections all have approximately the same length along the periphery of said lid as the length of said waist portions between them.

5. The lid of claim 1, 2 or 3, where said lid is substantially circular, to be fitted to the bead of a circular beverage cup.

6. The lid of claim 1, 2 or 3, where said lid is substantially circular, to be fitted to the bead of a circular beverage cup; and where the inner surface of said cavity is transversely arcuate.

7. The lid of claim 1, 2 or 3, where said lid is substantially circular, to be fitted to the bead of a circular beverage cup, and the inner surface of said cavity is transversely arcuate; and where each said upper undercut is at a point just below a vertical tangent to said cavity.

8. The lid of claim 1, 2 or 3, where the material of said lid is polystyrene.

* * * * *